US007712339B2

(12) United States Patent
Hentschel et al.

(10) Patent No.: US 7,712,339 B2
(45) Date of Patent: May 11, 2010

(54) JOINT ROD LOCK

(75) Inventors: Andreas Hentschel, Selters (DE); Martin Hommel, Rehe (DE); Hans-Theo Schafer, Rennerod (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 0 days.

(21) Appl. No.: 12/176,723

(22) Filed: Jul. 21, 2008

(65) Prior Publication Data

US 2009/0025437 A1 Jan. 29, 2009

(30) Foreign Application Priority Data

Jul. 27, 2007 (DE) ..... 10 2007 035 116

(51) Int. Cl.
*E05B 37/06* (2006.01)

(52) U.S. Cl. ..... 70/30; 70/49; 70/14; 70/18

(58) Field of Classification Search ..... 70/14, 70/18, 22, 24, 30, 38 C, 49
See application file for complete search history.

(56) References Cited

U.S. PATENT DOCUMENTS

| | | | | |
|---|---|---|---|---|
| 1,718,723 | A * | 6/1929 | Williams | 70/38 A |
| 5,791,169 | A * | 8/1998 | Kuo | 70/26 |
| 5,913,906 | A * | 6/1999 | Strocchi | 70/18 |
| 6,101,852 | A * | 8/2000 | Steinbach | 70/38 A |
| 6,386,005 | B1 * | 5/2002 | Kuo | 70/28 |
| 6,619,081 | B1 * | 9/2003 | Yu | 70/58 |
| 6,711,921 | B1 * | 3/2004 | Yang | 70/58 |
| 6,799,446 | B1 * | 10/2004 | Tsai | 70/30 |
| 6,820,448 | B1 * | 11/2004 | Hsieh | 70/18 |

(Continued)

FOREIGN PATENT DOCUMENTS

DE 3410047 A1 10/1985

(Continued)

OTHER PUBLICATIONS

German Search Report DE 10 2007 035 116.1 dated Apr. 22, 2008.

*Primary Examiner*—Suzanne D Barrett
(74) *Attorney, Agent, or Firm*—Gifford, Krass, Sprinkle, Anderson & Citkowski, P.C.

(57) ABSTRACT

A jointed bar lock having a lock body and a jointed bar hoop which has a first end and a second end, said first end being permanently connected to the lock body and said second end being connectable to the lock body at a latching region of the lock body, with a bolt provided at the lock body selectively being movable into a latched position in which the bolt engages it the second end of the jointed bar hoop when it is connected to the lock body or is movable into a release position in which the second end of the jointed bar hoop is released for a removal from the lock body. The lock has an actuation device which is coupled to the bolt via a connection section and by which the bolt is movable from the latched position, into which the bolt is biased, into the release position. The lock body accommodates a combination locking mechanism to selectively block or release the bolt. The actuation device is arranged disposed opposite the combination locking mechanism with respect to the latching region of the lock body.

14 Claims, 4 Drawing Sheets

U.S. PATENT DOCUMENTS

| | | | | |
|---|---|---|---|---|
| 7,185,518 | B1 * | 3/2007 | Huang | 70/14 |
| 7,249,475 | B2 * | 7/2007 | Yu | 70/18 |
| 7,437,898 | B2 * | 10/2008 | Su | 70/14 |
| 7,481,084 | B1 * | 1/2009 | Wu | 70/18 |
| 2005/0044903 | A1 * | 3/2005 | Ling et al. | 70/30 |

FOREIGN PATENT DOCUMENTS

| | | | |
|---|---|---|---|
| DE | 43 30 478 | C1 | 2/1995 |
| DE | 10 2005 040 066 | A1 | 3/2007 |

* cited by examiner

JOINT ROD LOCK

CROSS-REFERENCE TO RELATED APPLICATIONS

This application claims priority of German Patent Application No. 10 2007 035 116.1 filed Jul. 27, 2007.

FIELD OF THE INVENTION

The present invention relates to a jointed bar lock comprising a lock body and a jointed bar hoop having a first and a second end, said first end being permanently connected to the lock body and said second end being connectable to the lock body at a latching region of the lock body. A bolt provided at the lock body can selectively be moved into a latched position in which the bolt engages into the second end of the jointed bar hoop when the latter is connected to the lock body or the bolt can be moved into a release position in which the second end of the jointed bar hoop is released for a removal from the lock body.

BACKGROUND OF THE INVENTION

Such a jointed bar lock is known from DE 10 2005 040 066 A1 and serves, for example, for the securing of a two-wheeler to a bicycle stand, to a lamppost or the like. For this purpose, jointed bars of the jointed bar hoop pivotally connected to one another sequentially or in series are folded apart and a closing bar at which the second end of the jointed bar hoop is formed is latched to the lock body in order hereby to form a closed loop. This closed loop can, for example, engage around a frame section of the two-wheeler and the bicycle stand, lamppost or the like, or the jointed bar hoop only surrounds a rim of the two-wheeler to prevent unauthorized persons from riding away.

In the known jointed bar lock, a lock cylinder is used which is rotatably actuable by an associated key or another identification means to selectively move the bolt into the latched position or into the release position.

It is, however, disadvantageous in this connection that a key necessarily has to be taken along which is furthermore at risk of being lost. Many two-wheeler owners therefore prefer locks with a combination locking mechanism to secure their two-wheelers. With a customary arrangement of a combination locking mechanism at a cable lock, for example, an end face of the combination locking mechanism is freely accessible when the lock is open in order to be able to introduce a lock block axially. Such an arrangement can, however, not easily be realized with a jointed bar lock.

SUMMARY OF THE INVENTION

It is the underlying object of the invention to provide a jointed bar lock having a combination locking mechanism which is simple to operate and whose lock body has a small construction size.

This object is satisfied by a jointed bar lock having the features of claim 1 and in particular in that the lock has an actuation device which is coupled to the bolt via a connection section to move the bolt out of the latched position, into which the bolt is biased, into the release position; and in that the lock body accommodates a combination locking mechanism to selectively block or release the bolt, with the actuation device being arranged oppositely disposed to the combination locking mechanism with respect to the latching region of the lock body.

The combination locking mechanism is provided for the purpose of blocking the bolt in the named latched position or of releasing it for a movement into the named release position. The combination locking mechanism can be a combination locking mechanism known per se which has a plurality of rotatable number rings arranged next to one another which release the bolt of the jointed bar lock on the setting of a release number combination which corresponds to a preset rotational position of the number rings with respect to one another and which block the bolt in all other number combinations or rotational positions.

The combination locking mechanism and the actuation device are arranged on different sides with respect to the latching region of the lock body. The bolt is biased into the latched position. The bolt can thus be moved—provided it is released by the combination locking mechanism—into the release position by a simple pressing onto the actuation device coupled to the bolt via the connection section. The actuation device is consequently in particular a push button device.

It can hereby be achieved that the latching and unlatching of the second end of the jointed bar hoop to the lock body is possible in a particularly simple and comfortable manner when the combination locking mechanism is in a position in which the bolt is released. For the latching, for example, the actuation device can be pressed, then the second end of the jointed bar hoop can be introduced into the latching region of the lock body and finally the actuation device can be released again. For the unlatching, the actuation device can in turn first be pressed, then the second end of the jointed bar hoop can be removed from the latching region and finally the actuation device can be released again.

A non-secured holding of the second end of the jointed bar hoop at the latching region of the lock body is also possible by the biasing of the bolt into the latched position when the aforesaid release number combination is set at the combination locking mechanism, i.e. when the bolt is not blocked in the latched position. This, on the one hand, ensures that the combination locking mechanism does not also have to be adjusted simultaneously with the latching of the jointed bar hoop to the lock body. On the other hand, on the unlatching, the second end of the jointed bar hoop is not released directly and in an uncontrolled manner from the latching region of the lock body after the setting of the release number combination.

Furthermore, the lock body of the jointed bar lock can be formed in a particularly compact manner due to the simple design of the latching mechanism.

In accordance with a preferred embodiment, the named connection section, which couples the actuation device to the bolt, is fixedly connected to the bolt, is in particular an integral part of the bolt.

In accordance with a further embodiment of the invention, the connection section is laterally offset with respect to the longitudinal axis of the bolt which corresponds to the axis of rotation of the combination locking mechanism. A breaking-open tool, for example a screwdriver, which is introduced by force into the housing passage for the connection section, cannot easily penetrate into the bolt passage and thus into the region of the combination locking mechanism due to the eccentric arrangement of the connection section with respect to the longitudinal axis of the bolt. The securing against breaking open of the jointed bar lock can thus be increased.

The connection section is preferably made to be weaker; the connection section in particular has a smaller cross-sectional surface than the part of the bolt which is arranged in the latched position of the bolt in the latching region of the lock body. In the case of an attempt to break open, the connection section thus acts as a desired breakage point. If the connection section is broken, the bolt can no longer be moved and remains in the latching region of the lock housing so that the second end of the jointed bar hoop is blocked against removal from the lock body. It is sufficient in this respect for the connection section to be made weaker at least at one point than the part of the bolt located in the latched position in the latching region.

In accordance with another embodiment of the invention, the second end of the jointed bar hoop has an outwardly open passage slot which in particular extends parallel to the removal direction of the jointed bar hoop. This passage slot merges inwardly into a bolt reception opening which is widened with respect to the passage slot. The bolt reception opening is provided for the purpose of allowing an engagement of the bolt into the second end of the jointed bar hoop to bolt the second end of the jointed bar hoop to the latching region of the lock body. The width of the passage slot is smaller than the extent of the bolt reception opening in the corresponding direction to prevent an unthreading of the bolt through the passage slot in the latched position of the bolt. The width of the passage slot corresponds to the width of the connection section or is larger than its width so that the second end of the jointed bar hoop can be introduced into or removed from the lock body despite the connection section passing through the latching region. The passage slot is preferably formed at the axial end of the locking bar of the jointed bar hoop to enable an introduction of the locking bar into the latching region of the lock body which is axial with respect to the longitudinal axis of the locking bar. The passage slot can, however, generally also be formed to the side of the axial end of the locking bar at the second end of the jointed bar hoop to enable a lateral inward pivoting of the second end of the jointed bar hoop into the latching region of the lock body.

The latching region of the lock body preferably includes a support section which engages into the bolt reception opening of the second end of the jointed bar hoop, with the width of the support section corresponding at most to the width of the aforesaid passage slot. This makes it possible for the bolt located in the latched position to be supported at the support section of the lock body. The bolt is then stabilized with respect to a lateral application of force, for example when an attempt is made to pull the second end of the jointed bar hoop out of the lock body by force, without the bolt having to engage into a housing region of the lock body beyond the latching region, i.e. beyond the movement plane of the locking bar, for this purpose. The stability of the jointed bar hoop can hereby be increased. The increased stability is achieved in this respect with a minimal axial stroke of the bolt, whereby an advantageous construction height of the lock body is made possible. Since the width of the support section corresponds at most to the width of the passage slot, it can be ensured that the support section does not impede the introduction of the second end of the jointed bar hoop into the latching region of the lock body.

Provision can in particular be made for the support section of the lock body to engage into a support section mount formed at the end of the bolt axially facing the connection section, with the bolt having a blocking region which is adjacent to the support section mount and which abuts the support section as required. The stability of the jointed bar lock can hereby be further increased In accordance with a further embodiment of the invention, the bolt has a thickened portion at the end axially facing the connection section, said thickened portion being arranged in the latched position of the bolt in the latching region of the lock body. A laterally offset arrangement of the connection section with respect to the longitudinal axis of the bolt can be facilitated by the thickened portion. Furthermore, the contact region with which the bolt cooperates in a latching manner with the second end of the jointed bar hoop can be enlarged. The formation of a support section mount in the bolt can furthermore be facilitated. The thickened portion is preferably made as a plate section. The thickened portion can be arranged eccentrically to the longitudinal axis of the bolt.

It is furthermore preferred for the combination locking mechanism to have a combination locking adjustment mechanism which is arranged at the axial end of the combination locking mechanism disposed opposite the latching region. The adjustment mechanism is hereby easily accessible when a new release number combination should be set. The combination locking adjustment mechanism can be a known combination locking adjustment mechanism.

It is also advantageous for the second end of the jointed bar hoop to be hardened. The security against being broken open of the jointed bar lock can hereby be further increased.

Further embodiments of the invention are set forth in the dependent claims, in the description and in the drawing.

BRIEF DESCRIPTION OF THE DRAWINGS

The invention will be described in the following only by way of example with reference to the drawing.

There are shown, schematically in each case.

DETAILED DESCRIPTION OF THE PREFERRED EMBODIMENTS

Figure 1:
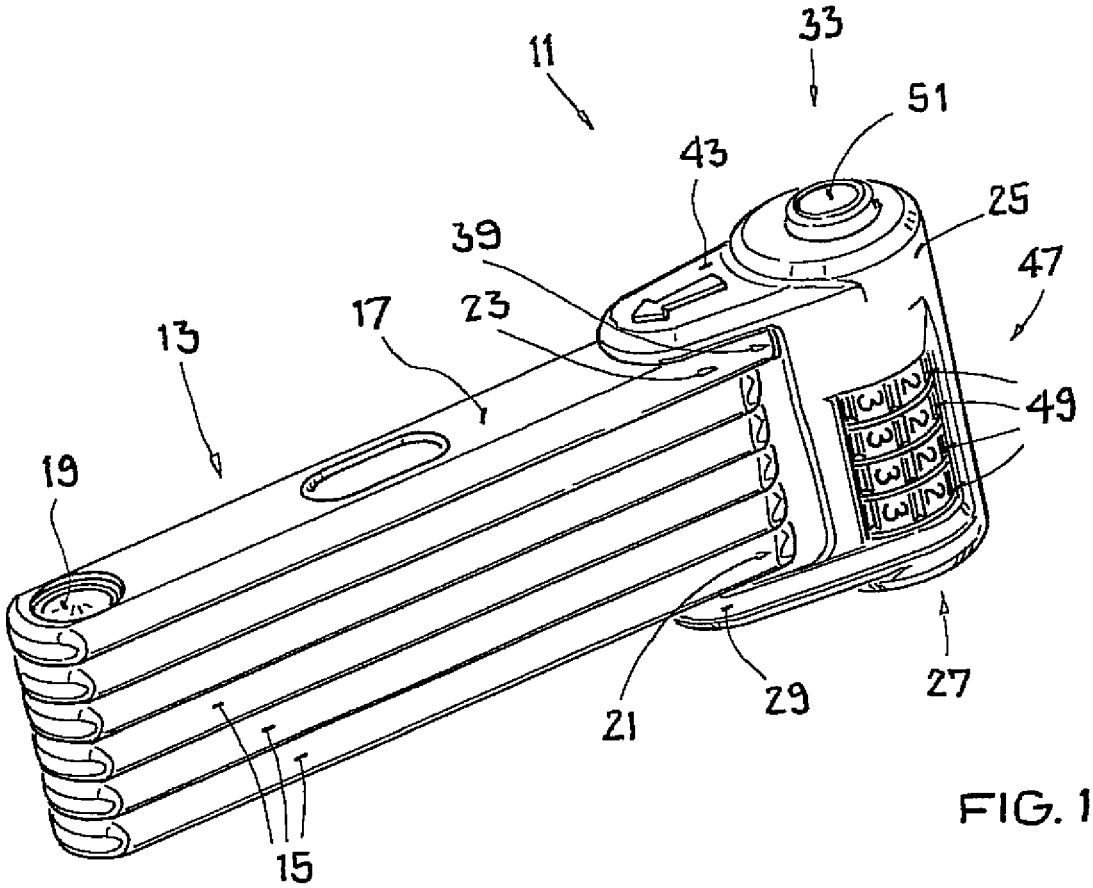
FIG. 1 a perspective view of a jointed bar lock obliquely from above.

The jointed bar lock shown has a lock body 11 and a jointed bar hoop 13 fastened thereto. The jointed bar hoop 13 can, as is in particular shown in FIGS. 1 and 2, be folded together to form a compact unit and can also be latched to the lock body 11 in this state. The jointed bar hoop 13 can, however, also be folded apart (not shown) to form a loop in a manner known per se and hereby to lock a two-wheeler or to secure it to another object, for example a bicycle stand.

The jointed bar hoop 13 in detail has a plurality of jointed bars 15 of which one is formed as a locking bar 17. The jointed bars 15, 17 are each made flat and consist of hardened steel. The jointed bars 15, 17 are pivotally connected to one another in series by a respective rivet 19 such that the joint axes extend parallel to one another and the jointed bar hoop 13 can be folded together in the manner of a yardstick. In the folded together state of the jointed bar hoop 13, the longitudinal axes of the jointed bars 15, 17 extend parallel to one another in a plane.

Figure 3:
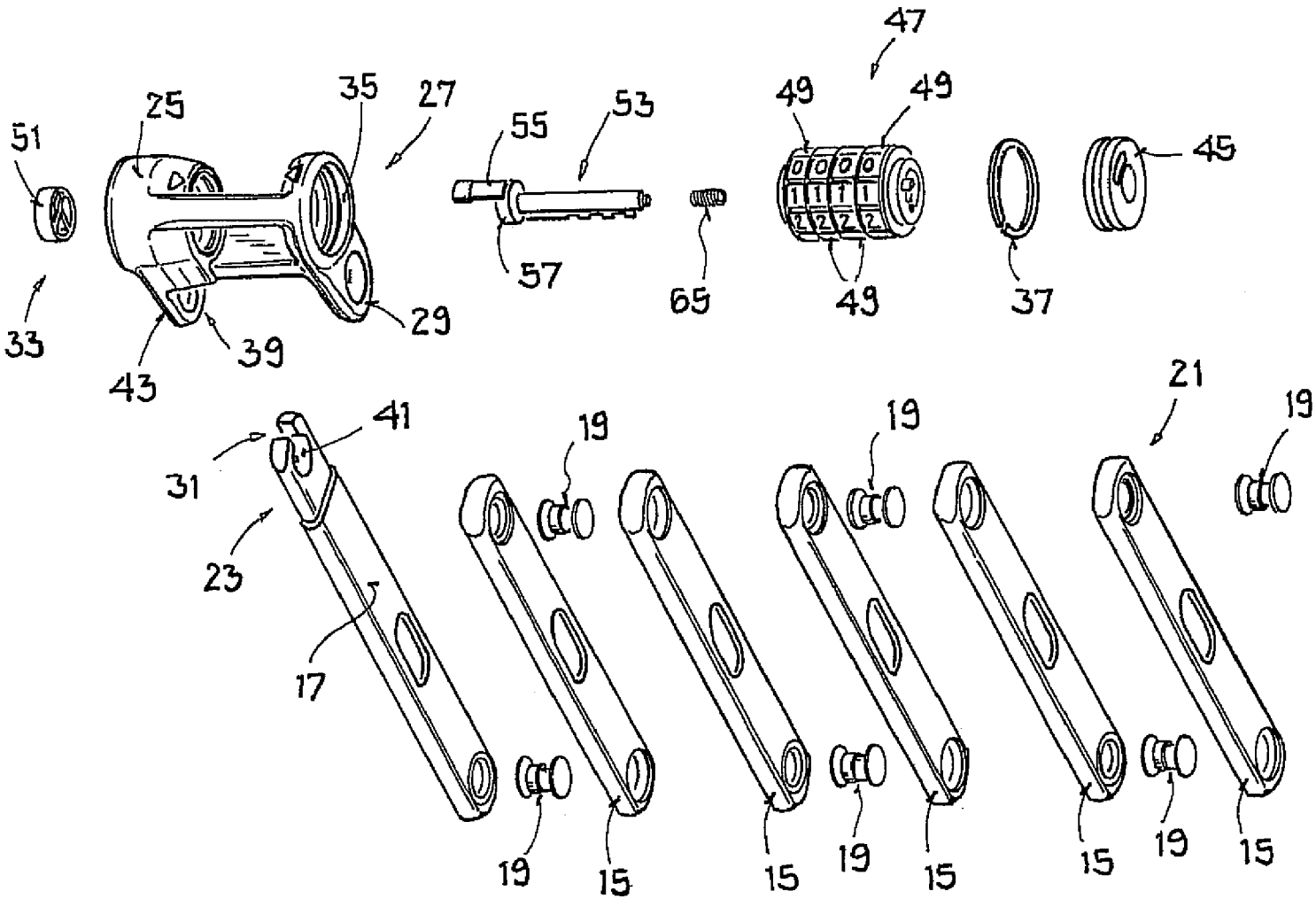
FIG. 3 an exploded view of the jointed bar lock of FIG. 1.

A first end 21 of the jointed bar hoop 13 formed in this manner is permanently pivotably connected to the lock body 11. A second end 23 of the jointed bar hoop 13 is formed by the free end of the locking bar 17. At its free end, the locking bar 17 in accordance with FIG. 3 has an outwardly open passage slot 31 which is formed along the longitudinal axis of the locking bar 17. The passage slot 31 merges at its inner end into a circular bolt reception opening 41 whose diameter is larger than the width of the passage slot 31.

The lock body 11 has an elongate housing 25, for example made of hardened steel, having a longitudinal axis which extends parallel to the joint axes of the jointed bars 15, 17.

At a first end 27 of the housing 25, a laterally projecting fastening section 29 is shaped at the housing 25 and the first end 21 of the jointed bar hoop 13 is pivotally connected to it. The housing 25 furthermore has at the end face at the first end 27 an assembly opening 35 which opens into a hollow space of the housing 25. A latching mechanism is inserted into the housing 25 via the assembly opening 35 and includes an elongate bolt 53 and a combination locking mechanism 47. The combination locking mechanism 47 has a combination locking adjustment mechanism at its end facing the assembly opening 35. The assembly opening 35 is closed by a closing plate 45 held by means of a securing ring 37.

The housing 25 has a side mount 39 at its second end 33 disposed opposite the first end 27. The side mount 39 is formed at a side surface of the housing 25 facing the jointed bar hoop 13 and serves for the mounting of the second end 23 of the jointed bar hoop 13 or of the free end of the locking bar 17. The side mount 39 merges into a latching region 59 (FIG. 2) of the lock body 11 in which the second end 23 of the jointed bar hoop 13 is located when the locking bar 17 is completely introduced into the lock body 11 through the side mount 39. The extent of the latching region 59 along the named longitudinal axis of the housing 25 is preset by the clearance of the side mount 39 which in turn corresponds to the height of the free end 23 of the locking bar 17.

If the locking bar 17 is introduced into the side mount 39, the locking bar 17 is surrounded by the boundary of the side mount 39 of the housing 25 in a substantially shape matched manner. A flat hoop support 43 is shaped at the second end 33 of the housing 25 at the housing 25 and projects laterally from the housing 25 flush with the fastening section 29 at the first end 27 of the housing 25. The spacing between the fastening section 29 and the hoop support 43 along the longitudinal axis of the housing 25 corresponds to the thickness or height of the folded together jointed bar hoop 13.

The combination locking mechanism 47 arranged in the hollow space of the housing 25 includes a plurality of rotatable number rings 49 which are arranged next to one another and which form a bolt passage in which the bolt 53 is inserted. The number rings 49 are configured to allow an axial movement of the bolt 53 along its longitudinal axis on an adjustably preset rotary position with respect to one another, whereas an axial movement of the bolt 53 is blocked in all other rotary positions of the number rings 49 with respect to one another. The bolt 53 has a plurality of lateral elevated portions and recesses arranged alternately along its longitudinal extent for this purpose. The preset rotary position which can also be called a bolt release position corresponds to a preset release number combination which can be set in a manner known per se by the aforesaid combination locking adjustment mechanism. An axial movement of the bar 53 with respect to its longitudinal axis can therefore be selectively blocked or released by means of the combination locking mechanism 47.

Figure 4A:
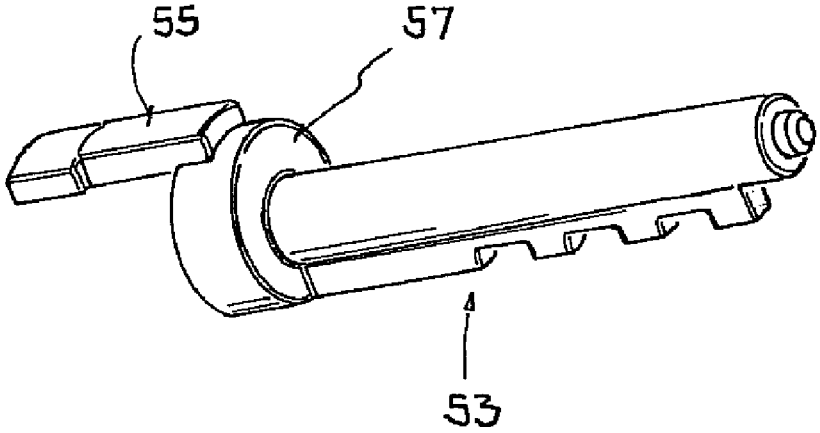
FIGS. 4*a* and 4*b* are an enlarged perspective view of the bolt visible in FIGS. 2 and 3.
Figure 4B:
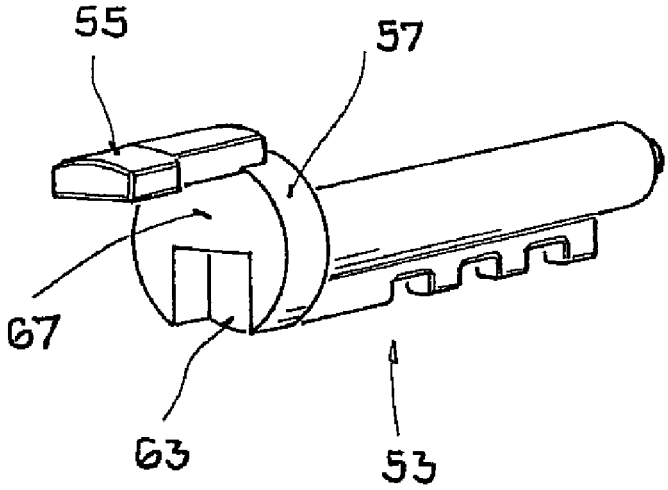

The bolt 53 projects in the direction of the second end 33 of the housing 25 out of the bolt passage which is formed by the combination locking mechanism 47. The bolt 53 is made as a plate section 57 at the end facing the second end 33 of the housing 25 (FIGS. 3, 4), with the plate section 57 being dimensioned larger in a direction radial to the longitudinal axis of the bolt 53 than the remaining section of the bolt 53. The plate section 57 is arranged eccentrically to the longitudinal axis of the bolt 53 in this respect.

An elongate connection section 55 to which a push button 51 is fastened is shaped at the plate section 57 of the bolt 53 and The connection section is made weaker having a smaller cross-sectional surface than the part of the bolt 53 which is arranged in the latched position of the bolt 53 in the latching region 59 of the look body 11. The connection section is laterally offset with respect to the longitudinal axis of the bolt 53 and is arranged at an outer periphery of the plate section 57. The push button 51 is arranged oppositely disposed the combination locking mechanism 47 with respect to the latching region 59, i.e. the push button 51 is arranged at a different side of the latching region 59 than the combination locking mechanism. Instead of a separate push button 51, a push button section can be integrally shaped in extension of the connection section 55.

Figure 2:
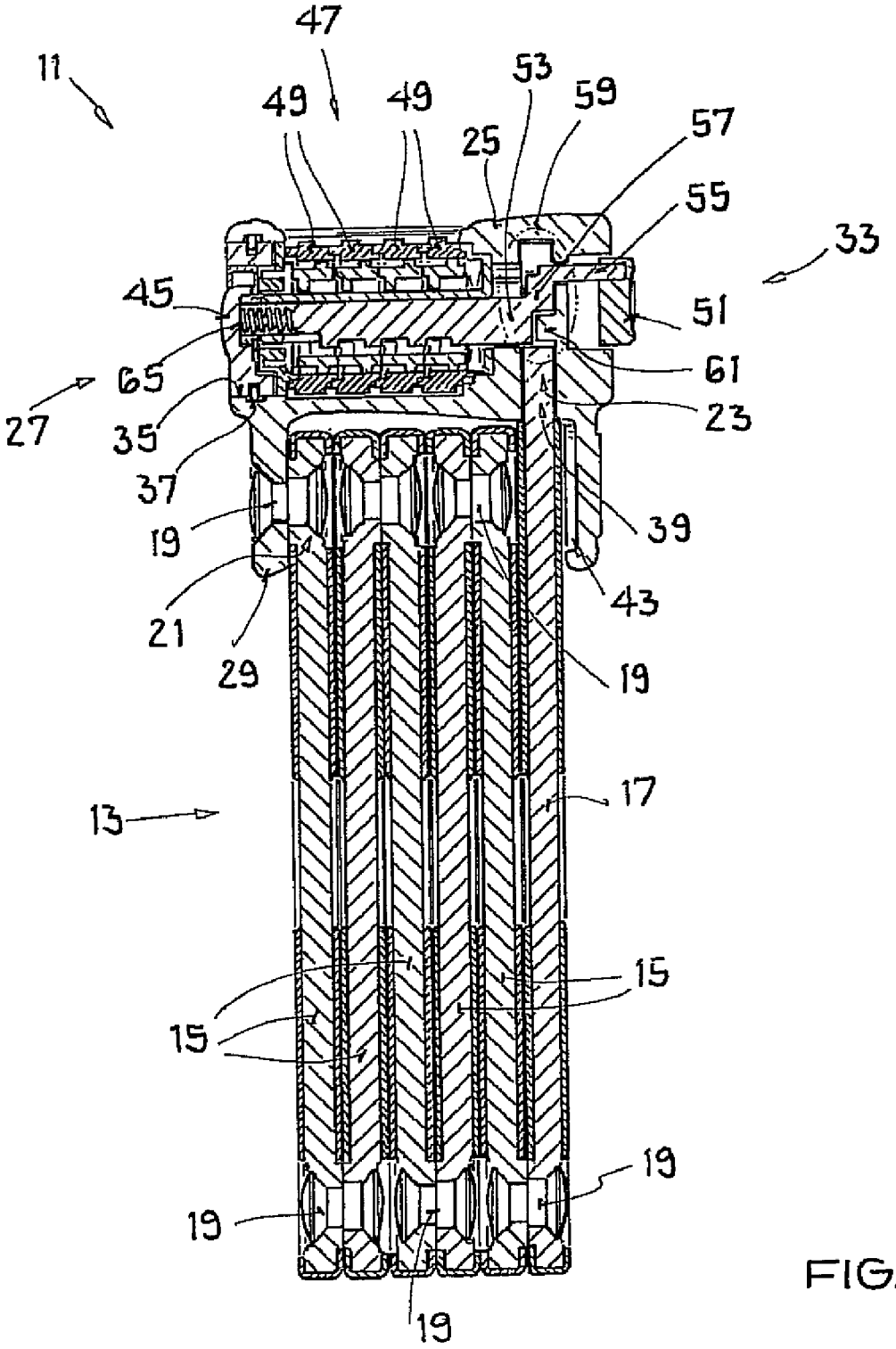
FIG. 2 a cross-sectional view of the jointed bar lock of FIG. 1.

The bolt 53 is shown in the latched position in FIG. 2, i.e. the bolt 53 engages into the second end 23 of the jointed bar hoop 13, with the bolt 53 being biased in the direction of the latched position by means of a spring 65 supported at an inner side of the closing plate 45. More precisely, the plate section 57 of the bolt 53 engages into the bolt reception opening 41 of the locking bar 17, with a refraction of the locking bar 17 from the lock body 11 being prevented due to the smaller width of the passage slot 31 with respect to the diameter of the plate section 57. The connection section 55 extends in the latched position of the bolt 53 through the passage slot 31 formed in the second end 23 of the jointed bar hoop 13.

Furthermore, the bolt 53 has at its end facing the second end 33 of the housing 25, i.e. at the plate section 57, a support section mount 63 which is arranged next to a blocking region 67 of the plate section 57 (FIG. 4) and into which a support section 61 (FIG. 2) of the lock body 11 engages, with the support section 61 being formed at an inner side of the second end 33 of the housing 25. An effective support of the bolt 53 can hereby be achieved if an attempt should be made to pull the locking bar 17 out of the lock body 11 by force. The width of the support section 61 corresponds approximately to the width of the passage slot 31 of the second end 23 of the jointed bar hoop 13 in order not to prevent the introduction of the second end 23 of the jointed bar hoop 13 into the lock body 11.

To enable a release of the locking bar 17 from the lock body 11, the bolt 53 is moved over the connection section 55 and against the bias of the spring 65 into a release position (not shown) by pressing the push button 51 which can be lowered in an outer recess of the housing 25. However, this requires that the combination locking mechanism 47 does not block the movement of the bolt 53. By moving the bolt 53 into the release position, the plate section 57 of the bolt 53 is moved out of engagement with the bolt reception opening 41 of the locking bar 17 at times so that the locking bar 17 can be pulled out of the latched section 59 and the side mount 39 of the lock body 11. The connection section 55 is admittedly located in the latching region 59 in this respect. However, the connection section 55 does not stand in the way of the removal of the locking bar 17 since the width of the connection section 55 corresponds approximately to the width of the passage slot 31 formed in the locking bar 17.

The jointed bar lock described with reference to the Figures with the combination locking mechanism enables a particularly simple operation on the basis of the bolt biased in the latched position and on the arrangement of the push button and of the combination locking mechanism disposed opposite with respect to the latching region, with a small construction size of the lock body simultaneously being able to be ensured.

The invention claimed is:

1. A jointed bar lock comprising a lock body (11) and a jointed bar hoop (13) which has a first end (21) and a second end (23), said first end (21) being permanently connected to the lock body (11) and said second end (23) being connectable to the lock body (11) at a latching region (59) of the lock body (11), with a bolt (53) provided at the lock body (11) selectively being movable into a latched position in which the bolt (53) engages into the second end (23) of the jointed bar hoop (13) when said second end is connected to the lock body (11) or being movable into a release position in which the second end (23) of the jointed bar hoop (3) is released for a removal from the lock body (11), comprising an actuation device (51) which is coupled to the bolt (53) via a connection section (55) and by which the bolt (53) can be moved from the latched position, into which the bolt (53) is biased, into the release position; wherein the lock body (11) accommodates a combination locking mechanism (47) to selectively block or release the bolt (53), with the actuation device (51) being disposed opposite the combination locking mechanism (47) with respect to the latching region (59) of the lock body (11), wherein the second end (23) of the jointed bar hoop (13) has an outwardly open passage slot (31), said open passage slot having a width at least as great as the width of the connection section (55), said open passage slot merging into a bolt reception opening having a width greater than the width of said open passage slot, and a portion of said bolt having a width greater than the width of said open passage slot is positioned in said bolt reception opening when said bolt is in said latched position.

2. A jointed bar lock in accordance with claim 1, wherein the connection section (55) is fixedly connected to the bolt (53) and is in particular made in one piece.

3. A jointed bar lock in accordance with claim 1, wherein the connection section (55) is arranged in the latching region (59) of the lock body (11) in the release position of the bolt (53).

4. A jointed bar lock in accordance with claim 1, wherein the actuation device (51) has a push button which is fixedly connected to the connection section (55); or in that the actuation device is formed by a push button section which is made in one piece with the bolt (53) and the connection section (55).

5. A jointed bar lock in accordance with claim 1, wherein the lock body (11) includes a support section (61) in the latching region (59) which engages into a bolt mount (41) of the jointed bar hoop (13) when the second end (23) of the jointed bar hoop (13) is connected to the lock body (11), with the width of the support section (61) corresponding at most to the width of the passage slot (31).

6. A jointed bar lock in accordance with claim 5, wherein the support section (61) of the lock body (11) engages into a support section mount (63) of The bolt (53) in the latched position of the bolt (53), with the bolt (53) having a blocking region (67) which is arranged adjacent to the support section mount (63) in a direction opposite to the removal direction of the jointed bar hoop (13).

7. A jointed bar lock in accordance with claim 1, wherein the bolt (53) has a thickened portion (57) at the end facing the connection section (55), said thickened portion being arranged in the latched position of the bolt (53) in the latching region (59) of the lock body (11).

8. A jointed bar lock in accordance with claim 7, wherein the thickened portion (57) is made as a plate section.

9. A jointed bar lock in accordance with claim 1, wherein the combination locking mechanism (47) has a combination locking adjustment mechanism which is arranged at the end of the combination locking mechanism (47) disposed opposite the latching region (59).

10. A jointed bar lock in accordance with claim 1, wherein the second end (23) of the jointed bar hoop (13) is hardened.

11. A jointed bar lock comprising a lock body (11) and a jointed bar hoop (13) which has a first end (21) and a second end (23), said first end (21) being permanently connected to the lock body (11) and said second end (23) being connectable to the lock body (11) at a latching region (59) of the lock body (11), with a bolt (53) provided at the lock body (11) selectively being movable into a latched position in which the bolt (53) engages into the second end (23) of the jointed bar hoop (13) when said second end is connected to the lock body (11) or being movable into a release position in which the second end (23) of the jointed bar hoop (3) is released for a removal from the lock body (11), comprising an actuation device (51) which is coupled to the bolt (53) via a connection section (55) and by which the bolt (53) can be moved from the latched position, into which the bolt (53) is biased, into the release position; wherein the lock body (11) accommodates a combination locking mechanism (47) to selectively block or release the bolt (53), with the actuation device (51) being disposed opposite the combination locking mechanism (47) with respect to the latching region (59) of the lock body (11), wherein the connection section (55) is laterally offset with respect to the longitudinal axis of the bolt (53).

12. A jointed bar lock comprising a lock body (11) and a jointed bar hoop (13) which has a first end (21) and a second end (23), said first end (21) being permanently connected to the lock body (11) and said second end (23) being connectable to the lock body (11) at a latching region (59) of the lock body (11), with a bolt (53) provided at the lock body (11) selectively being movable into a latched position in which the bolt (53) engages into the second end (23) of the jointed bar hoop (13) when said second end is connected to the lock body (11) or being movable into a release position in which the second end (23) of the jointed bar hoop (3) is released for a removal from the lock body (11), comprising an actuation device (51) which is coupled to the bolt (53) via a connection section (55) and by which the bolt (53) can be moved from the latched position, into which the bolt (53) is biased, into the release position; wherein the lock body (11) accommodates a combination locking mechanism (47) to selectively block or release the bolt (53), with the actuation device (51) being disposed opposite the combination locking mechanism (47) with respect to the latching region (59) of the lock body (11), wherein the connection section (55) is made weaker having a smaller cross-sectional area than the part of the bolt (53) which is arranged in the latched position of the bolt (53) in the latching region (59) of the lock body (11).

13. A jointed bar lock comprising a lock body (11) and a jointed bar hoop (13) which has a first end (21) and a second end (23), said first end (21) being permanently connected to the lock body (11) and said second end (23) being connectable to the lock body (11) at a latching region (59) of the lock body (11), with a bolt (53) provided at the lock body (11) selectively being movable into a latched position in which the bolt (53) engages into the second end (23) of the jointed bar hoop (13) when said second end is connected to the lock body (11) or being movable into a release position in which the second end (23) of the jointed bar hoop (3) is released for a removal from the lock body (11), comprising an actuation device (51) which is coupled to the bolt (53) via a connection section (55) and by which the bolt (53) can be moved from the latched position, into which the bolt (53) is biased, into the release position; wherein said actuation device is axially aligned with and spaced axiatly outward from said bolt, wherein the lock body (11) accommodates a combination locking mechanism (47)

to selectively block or release the bolt (53), with the actuation device (51) being disposed opposite the combination locking mechanism (47) with respect to the latching region (59) of the lock body (11), wherein the connection section (55) is laterally offset with respect to the longitudinal axis of the bolt (53).

14. A jointed bar lock comprising a lock body (11) and a jointed bar hoop (13) which has a first end (21) and a second end (23), said first end (21) being permanently connected to the lock body (11) and said second end (23) being connectable to the lock body (11) at a latching region (59) of the lock body (11)3 with a bolt (53) provided at the lock body (11) selectively being movable into a latched position in which the bolt (53) engages into the second end (23) of the jointed bar hoop (13) when said second end is connected to the lock body (11) or being movable into a release position in which the second end (23) of the jointed bar hoop (3) is released for a removal from the lock body (11), comprising an actuation device (51) which is coupled to the bolt (53) via a connection section (55) and by which the bolt (53) can be moved from the latched position, into which the bolt (53) is biased, into the release position; wherein said actuation device is axially aligned with and spaced axially outward from said bolt, wherein the lock body (11) accommodates a combination locking mechanism (47) to selectively block or release the bolt (53), with the actuation device (51) being disposed opposite the combination locking mechanism (47) with respect to the latching region (59) of the lock body (11), wherein the connection section (55) is made weaker than the part of the bolt (53) which is arranged in the latched position of the bolt (53) in the latching region (59) of the lock body (11).

* * * * *